US009593005B2

(12) United States Patent
Jersey et al.

(10) Patent No.: US 9,593,005 B2
(45) Date of Patent: Mar. 14, 2017

(54) DISPENSING SYSTEM WITH A COMMON DELIVERY PIPE

(71) Applicant: PEPSICO, INC., Purchase, NY (US)

(72) Inventors: Steven T. Jersey, Purchase, NY (US); Alexander Kirdin, Boston, MA (US); Georgy Martsinovskiy, Boston, MA (US); Igoris Misucenko, Boston, MA (US); Mikhail Verbitsky, Boston, MA (US)

(73) Assignee: PepsiCo, Inc., Purchase, NY (US)

( * ) Notice: Subject to any disclaimer, the term of this patent is extended or adjusted under 35 U.S.C. 154(b) by 41 days.

(21) Appl. No.: 14/423,025

(22) PCT Filed: Aug. 28, 2013

(86) PCT No.: PCT/US2013/057042

§ 371 (c)(1),
(2) Date: Feb. 20, 2015

(87) PCT Pub. No.: WO2014/036117

PCT Pub. Date: Mar. 6, 2014

(65) Prior Publication Data

US 2015/0210522 A1 Jul. 30, 2015

Related U.S. Application Data

(60) Provisional application No. 61/695,143, filed on Aug. 30, 2012.

(51) Int. Cl.

| | |
|---|---|
| ***B67D 1/00*** | (2006.01) |
| ***B67D 1/07*** | (2006.01) |
| *B67D 1/08* | (2006.01) |

(52) U.S. Cl.

CPC ..... *B67D 1/0034* (2013.01); *B67D 1/004* (2013.01); *B67D 1/0028* (2013.01);
(Continued)

(58) Field of Classification Search

CPC .. B67D 1/0034; B67D 1/0028; B67D 1/0035; B67D 1/004; B67D 1/0044;
(Continued)

(56) References Cited

U.S. PATENT DOCUMENTS

| | | | | |
|---|---|---|---|---|
| 4,753,370 | A | 6/1988 | Rudick | |
| 7,757,896 | B2 * | 7/2010 | Carpenter | B67D 1/0051 222/129.1 |

(Continued)

OTHER PUBLICATIONS

International Search Report and Written Opinion for PCT/US2013/057042, mailed on Jan. 31, 2014.

*Primary Examiner* — Frederick C Nicolas
(74) *Attorney, Agent, or Firm* — Sterne, Kessler, Goldstein & Fox P.L.L.C.

(57) ABSTRACT

The disclosure concerns apparatus comprising a first source of a first component, the first component one component for a finished free flowing food product and comprising a highly concentrated micro component. The apparatus includes a second source of a second component, the second component being another component for the finished free flowing food product. The apparatus includes a flow combiner configured to combine the first and second components to form a first mixture. The apparatus further includes a common delivery pipe configured to receive the first mixture from the flow combiner. The apparatus includes a dispenser configured to receive diluent flow from a third source, receive the first mixture from the common delivery pipe, combine the diluent flow with the first mixture to form a second mixture, and dispense the second mixture through a dispensing nozzle, the second mixture including the finished free flowing food product.

20 Claims, 9 Drawing Sheets

(52) U.S. Cl.
CPC ..... *B67D 1/0036* (2013.01); *B67D 1/0044* (2013.01); *B67D 1/0046* (2013.01); *B67D 1/07* (2013.01); *B67D 1/0078* (2013.01); *B67D 1/0888* (2013.01)

(58) Field of Classification Search
CPC ..... B67D 1/0046; B67D 1/0078; B67D 1/07; B67D 1/0888; B67D 1/0036
See application file for complete search history.

(56) References Cited

U.S. PATENT DOCUMENTS

| | | | | |
|---|---|---|---|---|
| 8,162,176 | B2 * | 4/2012 | Rudick | B67D 1/0888 222/1 |
| 8,251,258 | B2 * | 8/2012 | Rudick | B67D 1/0034 222/1 |
| 8,960,500 | B2 * | 2/2015 | van Opstal | B67D 1/0025 222/129.1 |
| 2007/0267441 | A1 | 11/2007 | Van Opstal et al. | |
| 2010/0163572 | A1 | 7/2010 | Downham | |
| 2010/0326562 | A1 | 12/2010 | Sheehy et al. | |
| 2012/0102998 | A1 * | 5/2012 | Chase | F25D 23/126 62/389 |

* cited by examiner

DISPENSING SYSTEM WITH A COMMON DELIVERY PIPE

CROSS REFERENCE TO RELATED APPLICATIONS

The present application is a U.S. National Phase of International Application No. PCT/US2013/057042, filed on Aug. 28, 2013, designating the United States of America and claiming priority to U.S. Provisional Application No. 61/695,143, filed Aug. 30, 2012, entitled "Dispensing System with a Common Delivery Pipe," the entire disclosures of which are hereby incorporated by reference in their entireties and for all purposes.

FIELD OF THE INVENTION

This disclosure relates generally to a dispensing system and method for the dispensing of beverages, e.g., for cafeterias, restaurants (including fast food restaurants), theatres, convenience stores, gas stations, and other entertainment and/or food service venues.

BACKGROUND

Various beverage dispensers, such as those at cafeterias, restaurants, theatres, and other entertainment and/or food service venues, typically have either a "drop in" dispenser apparatus or a counter top type dispenser apparatus. In a drop in dispenser apparatus, the dispenser apparatus is self-contained and may be dropped into an aperture of a counter top. In a counter top type dispenser apparatus, the dispenser apparatus is placed on a counter top. In conventional beverage dispensers, a dispensing head is coupled to a particular drink syrup supply source via a single pipe dedicated to supply the particular drink syrup to that dispensing head, wherein the particular drink syrup supply source is typically located near the counter top, i.e., directly under the counter top, or directly over the counter top.

A user will typically place a cup under the signage of the selected beverage and either press a button or press the cup against a dispensing lever to activate the dispenser so that the selected beverage is delivered from the dispensing head corresponding to the selected beverage and into the cup until pressure is withdrawn from the button or lever.

Conventional dispensing machines may dispense a number of beverages. Each of dispensed beverages may consist of a number of components, such as flavors, acidulants, sweeteners, and diluents (e.g., water). In conventional dispensing machines, the required components of a beverage are dispensed via a common dispensing nozzle and each component is typically delivered to the dispensing nozzle via a separate delivery pipe, as shown e.g., in FIG. 1. As the variety of the dispensed beverages increases, correspondingly the number of various beverage components also increases. As a result, it becomes problematic to fit and lay out all the required delivery pipes within a dispensing machine as well as to connect all of them to the dispensing nozzle. In addition, the design of the dispensing nozzle becomes more complicated.

Conventional beverage dispensers are typically limited to dispensing drinks having flavoring supply sources located at their respective counters. Thus, a limited number of drinks are typically available at a conventional beverage dispenser. For example, drinks typically available at a conventional beverage dispenser are a regular cola beverage, a diet cola beverage, perhaps one or several non-cola carbonated beverages, such as a lemon-lime flavored carbonated beverage or some other fruit-flavored drink (e.g., orange flavored carbonated beverage, and/or root beer), and perhaps one more non-carbonated beverage(s), such as a tea and/or a lemonade.

Conventional dispensers are not typically configured to permit a user generate or receive from a single dispensing head a custom-ordered beverage that a consumer may wish to purchase, e.g., a cola flavored with cherry, vanilla, lemon, or lime, etc., or a tea flavored with lemon, orange, peach, raspberry, etc., or a tea having one or more teaspoons of sweetener (sugar, or some other nutritive sweetener or non-nutritive sweetener).

Conventional dispensers typically require servicing and resupply of flavoring sources at the counter.

Conventional dispensers typically require a dedicated dispensing head for each particular beverage.

What is needed is a beverage dispensing system that does not have the limitations and disadvantages of conventional beverage dispensers and methods.

SUMMARY

Accordingly, there is provided a system or apparatus comprising a common delivery pipe.

In an aspect, an apparatus is provided, the apparatus comprising a first source of a first component, the first component one component for a finished free flowing food product and comprising a highly concentrated micro component. The apparatus comprises a second source of a second component, the second component being another component for the finished free flowing food product. The apparatus comprises a flow combiner. The flow combiner is configured to receive the first component from the first source. The flow combiner is configured to receive the second component from the second source. The flow combiner is configured to combine the first component with the second component to form a first mixture. The apparatus comprises a common delivery pipe, the common delivery pipe configured to receive the first mixture from the flow combiner. The apparatus comprises a third source of a diluent flow. The apparatus comprises a dispenser, the dispenser comprising a dispensing nozzle, the dispenser configured to receive diluent flow from the third source, receive the first mixture from the common delivery pipe, combine the diluent flow with the first mixture to form a second mixture, and dispense the second mixture through the dispensing nozzle, the second mixture comprising the finished free flowing food product.

In one aspect, an apparatus comprising an auxiliary diluent flow source may be provided. The apparatus may comprise a first source of a first component, the first component being a first component for a free flowing food product and comprising a highly concentrated micro component. The apparatus may comprise a second source of a second component, the second component being a second component for the free flowing food product, the second component selected from the group consisting of a second highly concentrated micro component and a macro component. The apparatus may comprise a first flow combiner, the first flow combiner configured to receive the first component from the first source, receive auxiliary diluent from the auxiliary diluent flow source, and combine the first component with the auxiliary diluent flow to form a first intermediate mixture. The apparatus may comprise a second flow combiner, the flow combiner configured to receive the first intermediate mixture from the first flow combiner, receive the second component from the second source, and combine the first intermediate mixture with the second component to form a second intermediate mixture. The apparatus may comprise a common delivery pipe, the common delivery pipe configured to receive the second intermediate mixture from the second flow combiner. The apparatus may comprise a main diluent flow source. The apparatus may comprise a dispenser. The dispenser may be configured to receive main diluent flow from the main diluent flow source, receive the second intermediate mixture from the common delivery pipe, combine the main diluent flow with the first mixture to form a finished free flowing food product, and dispense the second finished free flowing food product through the dispenser.

In one aspect, a method is the provided. The method may comprise conveying a first component of a free flowing food product through a common delivery pipe to a dispenser for a first period of time. The method may comprise conveying a second component of a free flowing food product through a common delivery pipe to a dispenser for a second period of time. The method may comprise stopping the conveying of the first component. The method may comprise stopping the conveying of the second component. The method may comprise, upon stopping the conveying of the first component and the second component, conveying a diluent for a third period of time through the common delivery pipe to wash any of the remaining first component and any of the remaining second component away from the common delivery pipe.

The above and other aspects, features and advantages of the present disclosure will be apparent from the following detailed description of the illustrated embodiments thereof which are to be read in connection with the accompanying drawings.

DETAILED DESCRIPTION

Figure 1:
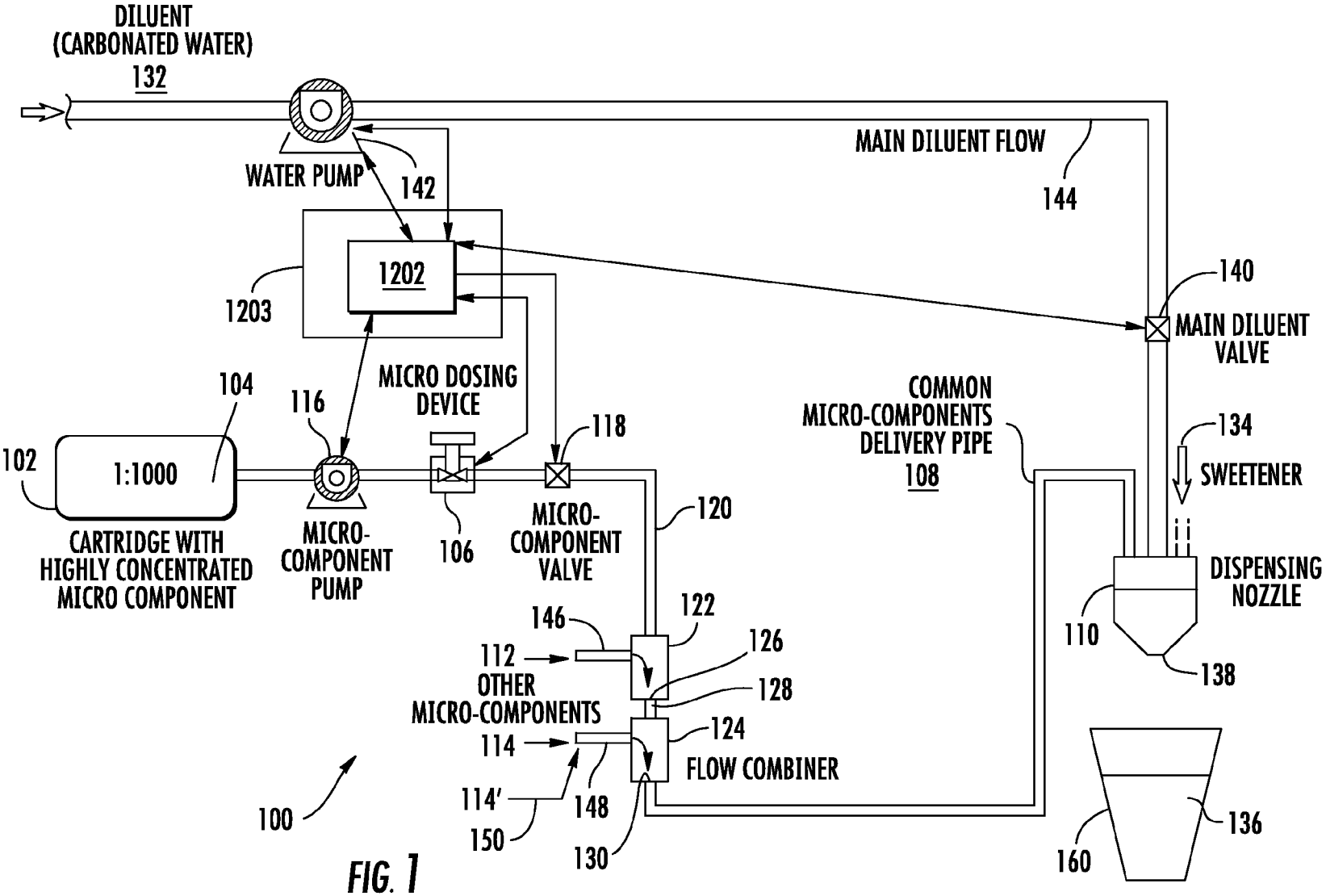
FIG. 1 illustrates a schematic view of an embodiment of a dispensing system in accordance with various aspects of the disclosure.

The embodiments discussed below may be used to form a wide variety of beverages, including but not limited to cold and hot beverages, and including but not limited to beverages known under any PepsiCo branded name, such as Pepsi-Cola®.

Those of skill in the art will recognize that in accordance with the disclosure a transfer unit or dosing system and/or portions thereof that feed a dispenser with a free flowing product may be located remotely from a counter, such as in a back room, or at the counter, such as below or over the counter.

In an aspect, an apparatus is provided, the apparatus comprising a first source of a first component, the first component one component for a finished free flowing food product and comprising a highly concentrated micro component. The apparatus comprises a second source of a second component, the second component being another component for the finished free flowing food product. The apparatus comprises a flow combiner. The flow combiner is configured to receive the first component from the first source. The flow combiner is configured to receive the second component from the second source. The flow combiner is configured to combine the first component with the second component to form a first mixture. The apparatus comprises a common delivery pipe, the common delivery pipe configured to receive the first mixture from the flow combiner. The apparatus comprises a third source of a diluent flow. The apparatus comprises a dispenser, the dispenser comprising a dispensing nozzle, the dispenser configured to receive diluent flow from the third source, receive the first mixture from the common delivery pipe, combine the diluent flow with the first mixture to form a second mixture, and dispense the second mixture through the dispensing nozzle, the second mixture comprising the finished free flowing food product.

In accordance with various aspects of the disclosure, the first source may be a first cartridge and the second source may be a second cartridge. The second component may be selected from the group consisting of a second highly concentrated micro component and a macro component. The finished free-flowing food product may comprise a beverage. The apparatus may comprise a sweetener source, wherein the dispenser is configured to receive sweetener from the sweetener source and combine the sweetener, the first mixture, and the main diluent flow to form the finished free-flowing food product. The apparatus may further comprise a first micro dosing device configured to dose the first component to the flow combiner. The apparatus may comprise a second micro dosing device configured to dose the second component to the flow combiner.

In an aspect, the first source may comprise a highly concentrated micro component having a ratio by weight to a diluent of at least about 30:1. In an aspect, the first source may comprise a highly concentrated micro component having a ratio by weight to a diluent of at least about 1000:1.

In an aspect, the apparatus may further comprise an auxiliary diluent flow source configured to convey an auxiliary diluent flow to the flow combiner.

In an aspect, an apparatus is provided comprising a first source of a first component, the first component one component for a finished free flowing food product and comprising a highly concentrated micro component. The apparatus may comprise a second source of a second component, the second component being another component for the finished free flowing food product. The apparatus may comprise a third source of a main diluent flow. The apparatus may comprise a fourth source of an auxiliary diluent flow. The apparatus may comprise a first flow combiner. The first flow combiner configured to receive the first component from the first source. The first flow combiner may be configured to receive auxiliary diluent flow from the fourth source. The first flow combiner may be configured to combine the first component with the auxiliary diluent flow to form a first intermediate mixture. The apparatus may comprise a second flow combiner. The second flow combiner may be configured to receive the first intermediate mixture from the first flow combiner. The second flow combiner configured to receive the second component from the second source. The second flow combiner configured to combine the first intermediate mixture with the second component to form a second intermediate mixture. The apparatus may comprise a common delivery pipe. The common delivery pipe may be configured to receive the second intermediate mixture from the second flow combiner. The apparatus may comprise a dispenser, the dispenser comprising a dispensing nozzle. The dispenser may be configured to receive main diluent flow from the third source. The dispenser may be configured to receive the second intermediate mixture from the common delivery pipe. The dispenser may be configured to combine the main diluent flow with the second intermediate mixture to form a finished free flowing food product, and dispense the finished free flowing food product.

In an aspect, the apparatus may further comprise a fifth source of a diluent flow and a flow splitter configured to split the diluent flow from the fifth source into the third source and the fourth source. The flow splitter may be configured to split about 5-25% of the diluent flow from the fifth source into the fourth source, and about 95-75% of the diluent flow from the fifth source into the third source. In an aspect, flow from the fourth source provides a washing flow that washes away any of the first component and the second component from the common delivery pipe.

In an aspect, the apparatus may comprise a first component dosing device. The apparatus may comprise a first component valve. The first component valve may be configured to be in an open position when desired to convey the first component from the first component dosing device to the first flow combiner. The first component valve may be configured to be in a closed position when desired to not convey the first component from the first component dosing device to the first flow combiner. The apparatus may comprise a second component dosing device, and a second component valve. The second component valve may be configured to be in an open position when desired to convey the second component from the second component dosing device to the second flow combiner, the second component valve configured to be in a closed position when desired to not convey the second component from the second component dosing device to the second flow combiner. The apparatus may comprise an auxiliary diluent valve. The auxiliary diluent valve may be configured to be in an open position when desired to convey the auxiliary diluent flow from the fourth source to the first flow combiner. The auxiliary diluent valve may be configured to be in a closed position when desired to not convey the auxiliary diluent flow from the fourth source to the first flow combiner.

In an aspect, the apparatus may comprise a gas source configured to convey a gas to the first flow combiner when desired to purge any of the first component, the second component, the auxiliary diluent flow, and mixtures thereof from the common delivery pipe. The gas source may comprise a gas valve. The gas valve may be configured to be in an open position when desired to convey the gas from the gas source to the first flow combiner. The gas valve may be configured to be in a closed position when not desired to convey the gas from the gas source to the first flow combiner. In an aspect, the apparatus may further comprise a third flow combiner configured to receive the gas from the gas valve and convey the gas to the first flow combiner when the gas valve is in the open position.

In an aspect of the disclosure, a method is provided, the method comprising conveying a first component of a free flowing food product through a common delivery pipe to a dispenser for a first period of time. The method comprises conveying a second component of a free flowing food product through the common delivery pipe to a dispenser for a second period of time. The method comprises stopping the conveying of the first component. The method comprises stopping the conveying of the second component. The method comprises upon stopping the conveying of the first component and the second component, conveying a diluent for a third period of time through the common delivery pipe to wash any of the remaining first component and any of the second component away from the common delivery pipe.

In an aspect, the method may further comprise conveying a gas for a fourth period of time to purge any of the remaining diluent away from the common delivery pipe after the third period of time ends and the conveying of the diluent stops.

In an aspect of the disclosure, an apparatus is provided, the apparatus comprising a cartridge comprising a highly concentrated free flowing micro component having a ratio by weight of the highly concentrated free-flowing micro component to a diluent of at least about 30:1. In an aspect, the ratio by weight of the highly concentrated free-flowing micro component to a diluent of at least about 1000:1 may be provided. The apparatus may comprise a dosing device, the dosing device configured to intermittently dose a predetermined amount of the highly concentrated free-flowing micro component at a predetermined flow rate. The apparatus may comprise a controller, the controller configured to control the intermittent dosing by the dosing device.

In an aspect of the disclosure, a dispensing system is provided comprising a common delivery pipe. In one aspect, a dispensing system is provided that has a simplified design over conventional dispensing systems. The dispensing system disclosed herein may be configured to dispense a number of components, including but not limited to flavors, acidulants, sweeteners, and diluents (e.g., water).

In an aspect, a single common delivery pipe is provided. The common delivery pipe may be configured for delivering (in sequence) a number of components of a free flowing product. The free flowing product may be a food product, including for example, a beverage.

FIG. 1 illustrates a schematic view of an embodiment of the dispensing system in accordance with various aspects of the disclosure. A dispensing system 100 may comprise a source 102 of a highly concentrated micro component 104. Source 102 may be any suitable source, including but not limited to a cartridge, such as a Bag-in-Box ("BIB"), or a pressurized vessel, or a polyethylene terephthalate ("PET") bottle. System 100 may comprise a micro dosing device 106 that corresponds to the highly concentrated micro component 104. System 100 may comprise a single delivery pipe 108 that conveys highly concentrated micro component 104 to a dispenser 110.

Figure 2:
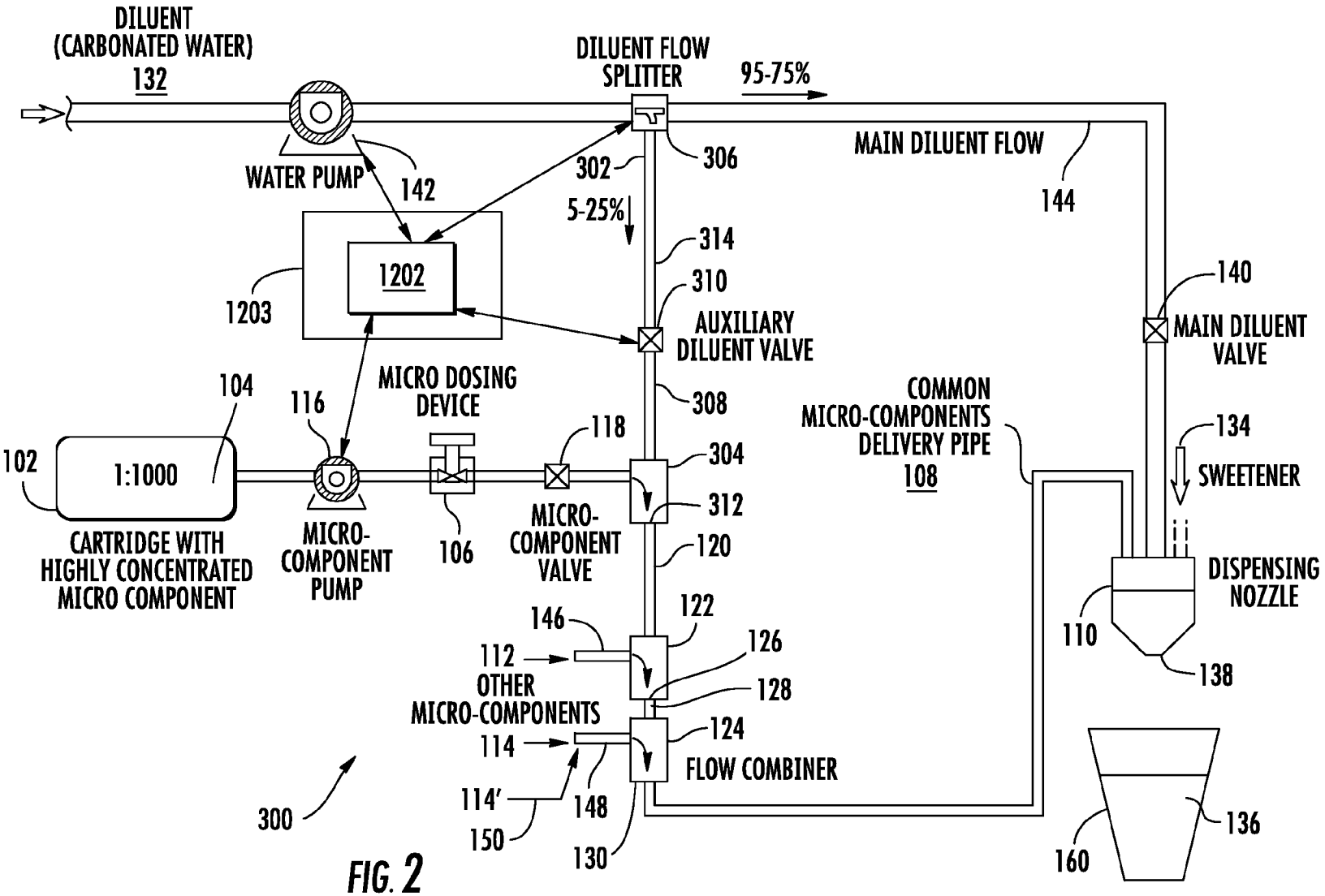
FIG. 2 illustrates a schematic view of an embodiment of a dispensing system in accordance with various aspects of the disclosure.

The system 100 may further comprise one or more other components 112, 114, and 114'. Components 112, 114 and 114' may each comprise a micro component or a macro component that is distinct from each other and micro component 104. As shown in FIG. 2, components 112 and 114 each have a corresponding flow combiner, 122 and 124, respectively. Component 112 may be conveyed through pipe 146 to flow combiner 122. Component 114 may be conveyed through pipe 148 to flow combiner 124. Component 114' may be conveyed through pipe 150 and a valve or flow combiner (not shown) to pipe 148. Alternatively, component 114' may be a corresponding flow combiner (not shown) located in series with flow combiners 122 and 124, that is separate and distinct from flow combiners 122 and 124, and a pipe (not shown) that conveys component 114' to such a separate and distinct flow combiner.

As shown in FIG. 1, a micro component pump 116 may be provided and configured to pump micro component 104 from source 102 through micro dosing device 106. The effluent of micro dosing device may flow through micro component valve 118 and through pipe 120 to flow combiner 122. At flow combiner 122, component 112 may be combined with micro component 104 to form a first mixture 126. First mixture 126 may flow from flow combiner 122, and through pipe 128 to flow combiner 124. At flow combiner 124, component 114 may be combined with the first mixture to form a second mixture 130. Mixture 130 may then flow through common delivery pipe 108 to dispenser 110.

As previously noted, components 112, 114, and 114' may each comprise a micro component or a macro component that is distinct from each other and micro component 104. Components 112, 114, and 114' may each have corresponding devices similar to devices that correspond to micro component 104. Thus, components 112 and 114 may each have a dosing device that is similar to micro dosing device 106, a pump similar to micro component pump 116, and a valve similar to micro component valve 118. Components 112, 114 and 114' may each have a corresponding source, such as a cartridge, similar to source 102.

The flow through common delivery pipe 108 may be combined with additional components at dispenser 110. For example, as shown in FIG. 1, in dispenser 110, flow through common delivery pipe 108 may be combined with a main diluent 132, and a sweetener 134 to form a finished free flowing product 136. Finished free flowing product 136 may be a food product, such as a finished beverage. Dispenser 110 may comprise a dispensing nozzle 138. Dispensing nozzle 138 may be configured to dispense finished free flowing product 136 from system 100 into a container or cup 160.

A main diluent valve 140 may be provided, through which main diluent 132 may be provided to dispenser 110. Main diluent 132 may be pumped by main diluent pump 142, to provide a main diluent flow 144 to dispenser 110. Main diluent 132 may be any suitable diluent, including but not limited to water, carbonated water, or a base of a free flowing product, such as a base for food product, including a beverage.

Dispensing system 100 may comprise dosing control unit 1203. Dosing control unit 1203 may comprise controller 1202. Controller 1202 may be operatively connected to dosing device 106. In accordance with an aspect of the disclosure, controller 1202 may be configured to control dosing by dosing device 106 of a highly concentrated micro component 104. As shown in FIG. 1, two-way communication may be provided between controller 1202 and dosing device 106 so that controller 1202 can deliver instructions to dosing device 106, and dosing device 106 can deliver to the controller 1202 information relating to the operation of dosing device 106. Dosing device 106 may be a dosing device configured to dose one or more liquid components of a plurality of sources. Each source may comprise a cartridge. Each source may comprise a component of a free flowing product. The free flowing product may comprise a food product. The food product may comprise a beverage. Thus, each source of the plurality of sources may comprise a highly concentrated micro component. Each highly concentrated micro component may comprise, for example, one or more of beverage ingredients.

As shown in FIG. 1, controller 1202 may be configured to control operation of micro component pump 116 and micro component valve 118 via two way communication between controller 1202 and micro component pump 116 and micro component valve 118, respectively.

Controller 1202 may be configured to control intermittent dosing of one or more other components 112, 114, and 114' in a similar manner as for micro component 104, e.g., controlling via two way communication (not shown) between controller 1202 and a micro dosing device, a micro component pump, and/or a micro component valve corresponding to each component 112, 114, and 114'.

Controller 1202 may be configured to control dosing of a sweetener 134, in a similar manner as for micro component 104, e.g., controlling via two way communication (not shown) between controller 1202 and a dosing device, a pump, and/or a component valve corresponding to the sweetener 134. In accordance with the disclosure, dosing of the sweetener may be intermittent or not intermittent. In accordance with the disclosure, a dosing device, a pump, and/or a component valve corresponding to the sweetener 134 may be a micro dosing device, a micro component pump, and/or a micro component valve corresponding to sweetener 134, respectively.

Controller 1202 may be configured to control operation of water pump 142 and main diluent valve 140 via two way communication between controller 1202 and water pump 142 and main diluent valve 140, respectively.

In a conventional system, components are delivered to a dispenser using individual pipes, rather than a common delivery pipe. Thus, a dispenser of a conventional system may need to have certain structure, such as a larger and more complex dispenser to account for the need to mix the micro components at the dispenser, unlike the dispenser 110 of system 100 of the present disclosure. Similarly, the dispensing nozzle in a conventional system may need to be larger and more complex than the dispensing nozzle 138 of the system 100 of the present disclosure. A conventional system may produce a product that may have different characteristic and not be the same as the finished free flowing product 136 produced by system 100 of the present disclosure.

As shown in FIG. 2, a system 300 may be provided wherein an auxiliary stream or portion 302 of diluent 132 may be directed to the common delivery pipe 108. Portion 302 may be used to mix with component 104 in flow combiner 304. In one example, about 5-25% by weight of diluent 132 in the finished free flowing product 136 may be supplied to dispenser 110 via common delivery pipe 108, and about 95-75% by weight of the diluent 132 in the finished free flowing product 136 may be supplied to dispenser 110 via main diluent flow 144.

Diluent 132 may be pumped by pump 142 to diluent flow splitter 306. Portion 302 may exit diluent flow splitter 306 through pipe 308 to flow combiner 304. In flow combiner 304, auxiliary portion 302 of diluent 132 may be combined with component 104 to form a mixture 312. Mixture 312 may then be conveyed through pipe 120 and through additional apparatus, such as flow combiner 122, etc. as shown in FIG. 2.

As shown in FIG. 2, to provide further control, an auxiliary diluent valve 310 may be provided between diluent flow splitter 306 and flow combiner 304. Portion 302 may flow from splitter 306 to flow combiner 304 through pipe 314.

To wash components 104, 112, 114, and/or 114' from flow combiners 304, 122, 124, and pipes 120, 128 and 108, and dispenser 110 and dispensing nozzle 138, the auxiliary portion 302 may be used. For example, for washing, valves corresponding to each micro component 104, 112, 114, and 114' may be closed, and only auxiliary portion 302 may be sent through flow combiners 304, 122, 124, and pipes 120, 128 and 108, and dispenser 110 and dispensing nozzle 138 for a sufficient time to accomplish the washing of micro components therefrom. By washing micro components from the above elements of system 300, cross-contamination between micro components may be reduced or eliminated.

Controller 1202, as previously described with respect to FIG. 1, may further comprise two way communications, as shown in FIG. 2, with diluent flow splitter 306 and/or auxiliary diluent value 310 to control the operation of diluent flow splitter 306 and/or auxiliary diluent valve 310.

Figure 3:
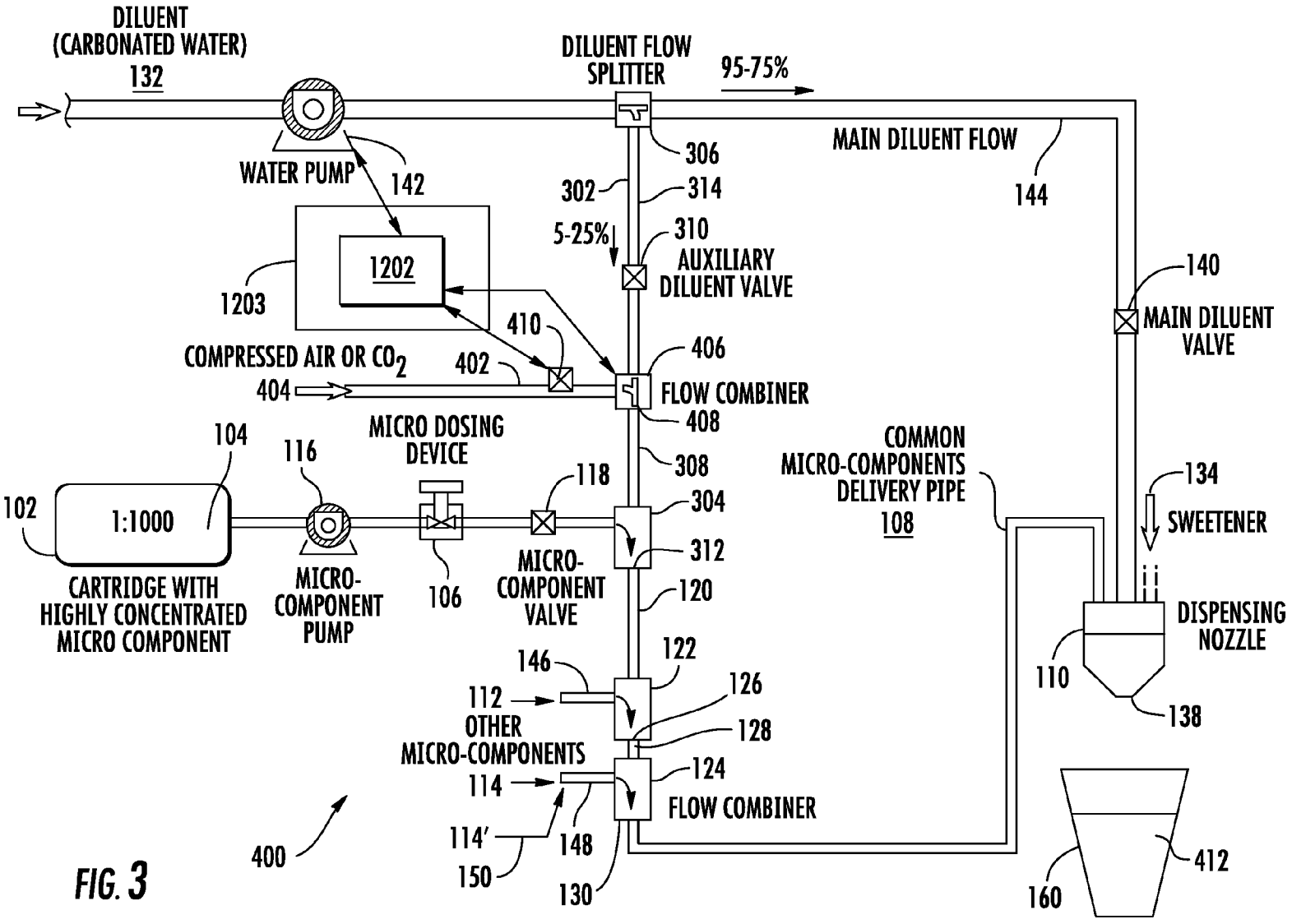
FIG. 3 illustrates a schematic view of an embodiment of a dispensing system in accordance with various aspects of the disclosure.

FIG. 3 illustrates system 400. System 400 may be the same as system as system 300 described above, and include a gas flow 402 from a gas source 404. Gas flow 402 may be controlled or regulated using valve 410. Gas flow 402 may comprise any suitable gas for purging of components from elements of the system. Thus, gas flow 402 may comprise compressed air, carbon dioxide, or an inert gas.

Gas flow 402 may be used to purge components 104, 112, 114, and/or 114' from flow combiners 304, 122, 124, and pipes 120, 128 and 108, and dispenser 110 and dispensing nozzle 138. For example, for purging, valves corresponding to each micro component 104, 112, 114, and 114' may be closed, and only gas flow 402 may be sent through flow combiners 304, 122, 124, and pipes 120, 128 and 108, and dispenser 110 and dispensing nozzle 138 for a sufficient time to accomplish the purging of micro components therefrom. By purging micro components from the above elements of system 400, cross-contamination between micro components may be reduced or eliminated. Purging can be done using gas flow 402 after washing using auxiliary portion 302.

Gas flow 402 may be combined with portion 302 in flow combiner 406 to form a mixture 408. Mixture 408 may be conveyed through pipe 308 to flow combiner 304.

Gas flow 402 may be used to increase the amount of carbonation for a finished beverage 412. Thus, when desired, gas flow 402 may be combined with portion 302 to form mixture 408, and mixture 408 may be combined with components 104, 112, 114, and/or 114,' and conveyed through common delivery pipe 108 to dispenser 110. At dispenser 110, the mixture from pipe 108 may be combined with main diluent flow 144, and sweetener 134 to form a finished beverage 412. Finished beverage 412 may thus have more carbonation than finished beverage 136 produced using the system depicted in FIG. 2.

Controller 1202, as previously described with respect to FIG. 1 and FIG. 2, may further comprise two way communications, as shown in FIG. 3, with valve 410 and/or flow combiner 406 to control the operation of valve 410 and/or flow combiner 406. Similarly, controller 1202 may be configured to control operation of other flow combiners 304, 122, and 124, as well as other pumps, dosing devices and valves associated with other components 112, 114, and 114'.

In a conventional approach, macro components and micro components are each dispensed during the same time period through their respective individual delivery pipes to a dispenser.

Figure 4:
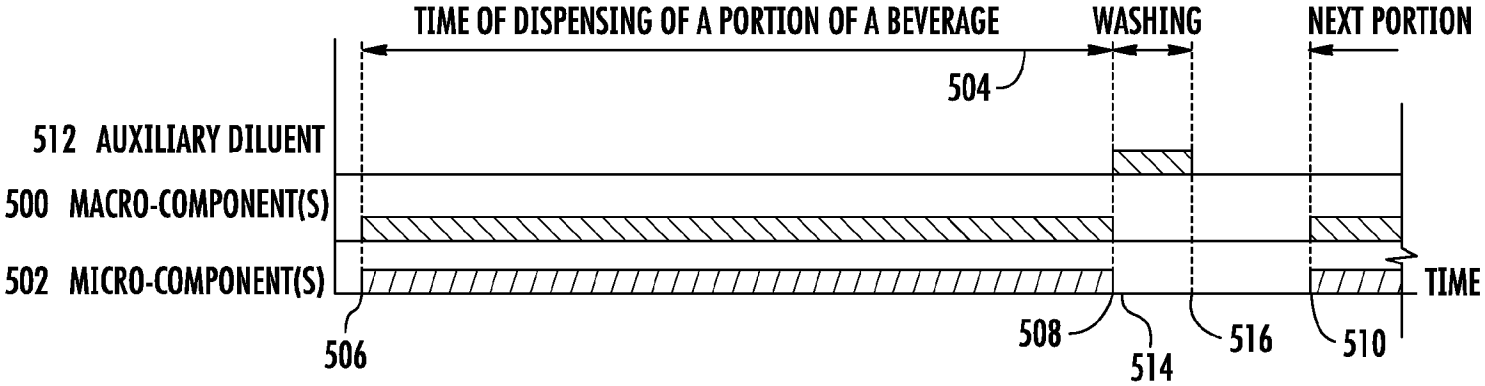
FIG. 4 illustrates a time diagram of dispensing in accordance with various aspects of the disclosure.

FIG. 4 illustrates a time diagram of an approach in accordance with aspects of the disclosure. As shown in FIG. 4, macro component(s) 500 and micro component(s) 502 are each dispensed during the same time period 504 through a common delivery pipe to a dispenser. Dispensing of macro component(s) 500 and micro component(s) 502 through a common delivery pipe may begin at time 506 and end at time 508. Dispensing of auxiliary diluent portion 512 through the common delivery pipe to a dispenser may be begin at time 514 and end at time 516. As shown in FIG. 4, time 514 may be the same as time 508. Time 514 may be later than time 508. The dispensing of auxiliary diluent portion 512 between from time 514 to time 516 allows the auxiliary diluent portion 512 to wash macro component(s) 500 and micro component(s) 502 from the common delivery pipe. The process may be repeated starting at time 510. As shown in FIG. 4, time 510 may be later than time 516. Micro component(s) 502 may be the same as or similar to micro component 104, previously discussed. Macro component(s) 500 may be the as or similar to macro component(s) and/or micro component(s) 112, 114 and/or 114,' previously discussed.

Figure 5:
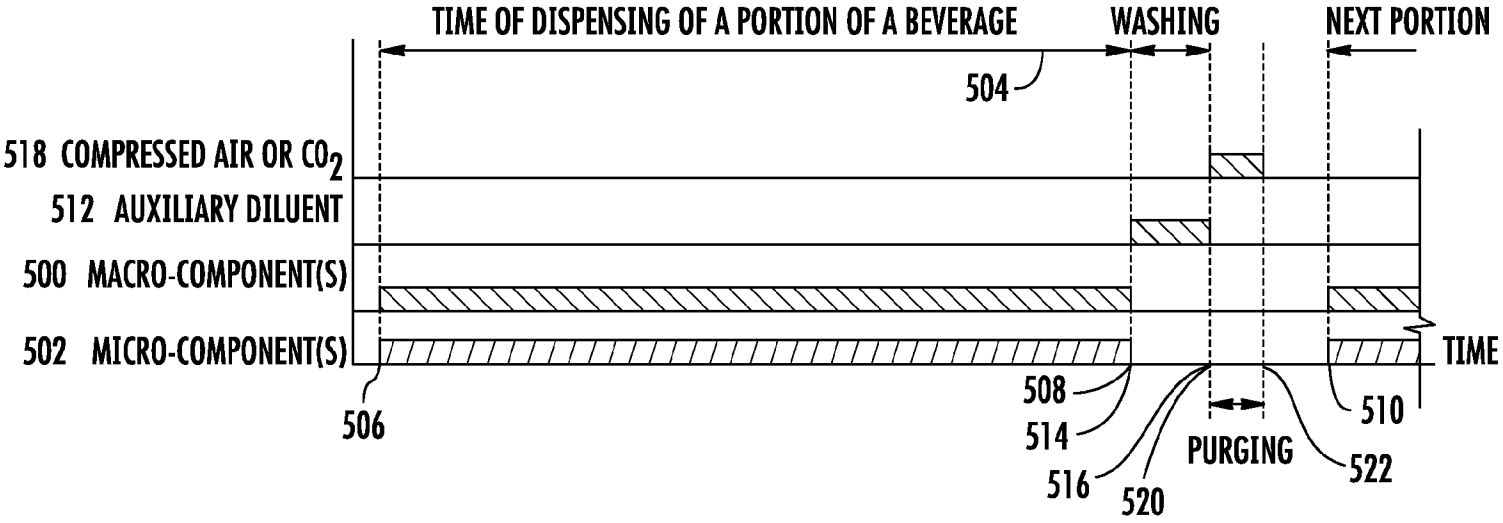
FIG. 5 illustrates a time diagram of dispensing in accordance with various aspects of the disclosure.

FIG. 5 illustrates a time diagram of an approach in accordance with aspects of the disclosure. FIG. 5 is the same as FIG. 4, with the addition of a purging step using a gas flow after the washing step. Dispensing of gas flow 518 through the common delivery pipe to the dispenser may begin at time 520 and end at time 522. As shown in FIG. 5, time 520 may be the same as time 516. Time 520 may be later than time 516. The dispensing of gas flow 518 between from time 520 to time 522 allows the gas flow to purge auxiliary diluent portion 512, macro component(s) 500 and micro component(s) 502 from the common delivery pipe. The process may be repeated starting at time 510. As shown in FIG. 5, time 510 may be later than time 516. Those of skill in the art will recognize that in accordance with the disclosure time 510 may be the same as time 522. Gas flow 518 may be the same as or similar to gas flow 402, previously discussed.

In one aspect, a dispensing system is provided, the dispensing system comprising a first source of a first highly concentrated micro component, and a source of a second highly concentrated micro component. The dispensing system may comprise a first micro dosing device in fluid communication with the first source, the first micro dosing device configured to receive the first highly concentrated micro component from the first source and dose a predetermined amount of the first highly concentrated micro component. The dispensing system may comprise a second micro dosing device in fluid communication with the second source, the second micro dosing device configured to receive the second highly concentrated micro component from the second source and dose a predetermined amount of the second highly concentrated micro component. The dispensing system may comprise a flow combiner, the flow combiner configured to combine flow of the first highly concentrated micro component dosed by the first micro dosing device and flow of the second highly concentrated micro component dosed by the second micro dosing device to form a combined flow of the first and second highly concentrated micro components. The combined flow of the first and second highly concentrated micro components may be conveyed by a common micro components delivery pipe to a dispenser. The dispenser may be configured to receive additional components and mix the additional components with the combined flow of the first and second highly concentrated micro components to form a finished free flowing product. The dispenser may comprise a dispensing nozzle. The dispensing nozzle may be configured to dispense the finished free flowing product.

In one aspect, a method is provided, the method comprising dosing a predetermined amount of a first highly concentrated micro component by a first micro dosing device, and dosing a predetermined amount of a second highly concentrated micro component by a second micro dosing device. The method may comprise combining the predetermined amount of the first highly concentrated micro component and the predetermined amount of the second highly concentrated micro component and form a combined flow of the first and second highly concentrated micro components. The method may comprise conveying the combined flow of the first and second highly concentrated micro components in a common micro component delivery pipe to a dispenser. The method may comprise receiving additional components and mixing the additional components with the combined flow of the first and second highly concentrated micro components to form a finished free flowing product. The method may comprise dispensing the finished free flowing product from the dispenser.

In accordance with the disclosure, the overall number of the delivery pipes may be significantly reduced and the design of the dispensing nozzle may be considerably simplified. In addition, in order to prevent possible cross-contamination problems that may be associated with a common delivery pipe, the disclosure provides for the use of auxiliary flows of the existing diluent(s) or water for washing the common delivery pipe between dispensing of different beverages. In addition, after washing, the common delivery pipe may be purged to remove any residues of the washing agent along with the residues of the previously delivered components.

Benefits of the present disclosure include simplified design of dispensing systems or machines, including systems or machines for the dispensing of multiple beverages. For example, in accordance with the present disclosure, a reduced number of delivery pipes are necessary, and dispensers and/or dispensing nozzles need not have structure necessary to accommodate multiple delivery pipes for micro and macro components as in conventional systems. In accordance with the present disclosure, dispensers and/or dispensing nozzles need not have structure necessary to accommodate mixing of micro and macro components as conventional systems.

Figure 6:
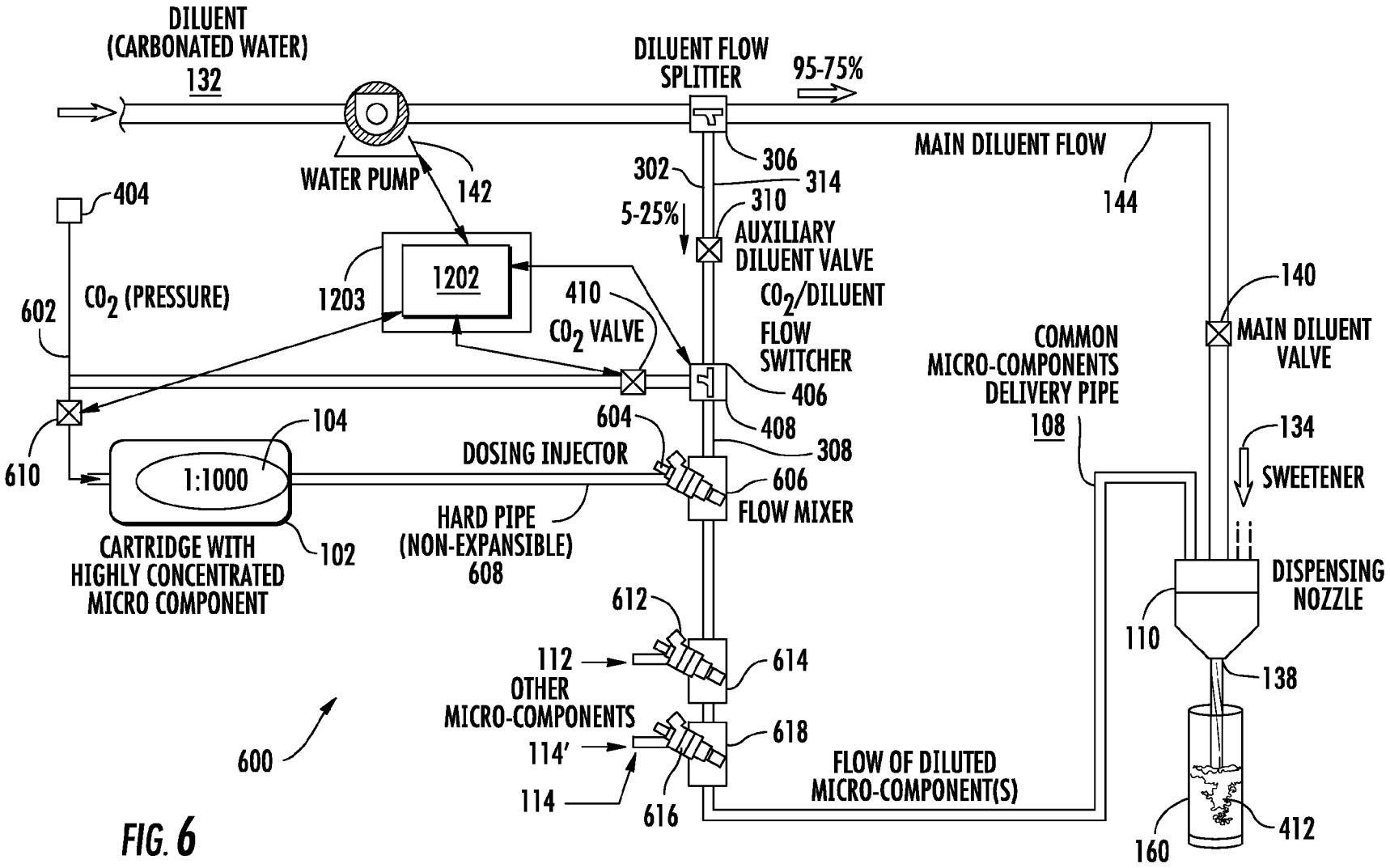
FIG. 6 illustrates a schematic view of an embodiment of a dispensing system in accordance with various aspects of the disclosure.

FIG. 6 is a schematic view of an embodiment of a dispensing system 600 according to various aspects of the disclosure. Dispensing system 600 is similar to dispensing system 400 shown in FIG. 3. Dispensing system 600 shows that a gas may be sent to source 102 where the gas exerts pressure to push a highly concentrated micro component 104 out of source 102. As previously noted, source 102 may comprise a cartridge. Thus, the gas may be used to exert pressure to push highly concentrated micro component 104 out of a cartridge of source 102. Dispensing system 600 may include a valve 610 to control the flow of gas, i.e., gas flow 602. Gas flow 602 may come from a suitable gas source, such as the gas source 404 shown in FIG. 3. Controller 1202, as previously described with respect to FIG. 1, FIG. 2, and FIG. 3, may further be configured to control operation of valve 610 via two way communications as shown in FIG. 6, and thus control gas flow 602 to any particular source, such as source 102. Controller 1202 may control operation of any other devices in dispensing system 600, similar in its control of operation of other devices in dispensing system 100 of FIG. 1, dispensing system 300 of FIG. 2, and dispensing system 400 of FIG. 3.

FIG. 6 shows dosing injector 604 and flow mixer 606, which may be, in combination, an alternative to dosing device 106, valve 118 and flow combiner 304 shown in FIG. 3. Similarly, FIG. 6 shows dosing injector 612 and flow mixer 614, which may be, in combination, an alternative to flow combiner 122 shown in FIG. 3, and a corresponding dosing device and valve (not shown in FIG. 3). Similarly, FIG. 6 shows dosing injector 616 and flow mixer 618, which may be, in combination, an alternative to flow combiner 124 shown in FIG. 3, and a corresponding dosing device and valve (not shown in FIG. 3).

Carbon dioxide, nitrogen ($N_2$) or other gas may be used to apply pressure to source 102, such as a cartridge or bottle of source 102 to push a highly concentrated micro component out of source 102 and through pipe 608 to dosing injector 604. The carbon dioxide or other gas may be supplied from gas flow 602. Gas flow 602 may split into additional gas flows or lines (not shown) in order to provide gas to other containers for components other than component 104. Thus, additional gas streams may be used to provide pressure and push components 112, 114, and 114' to corresponding dosing injector 612 and flow mixer 614, and dosing injector 616 and flow mixer 618, as shown in FIG. 6.

Figure 7:
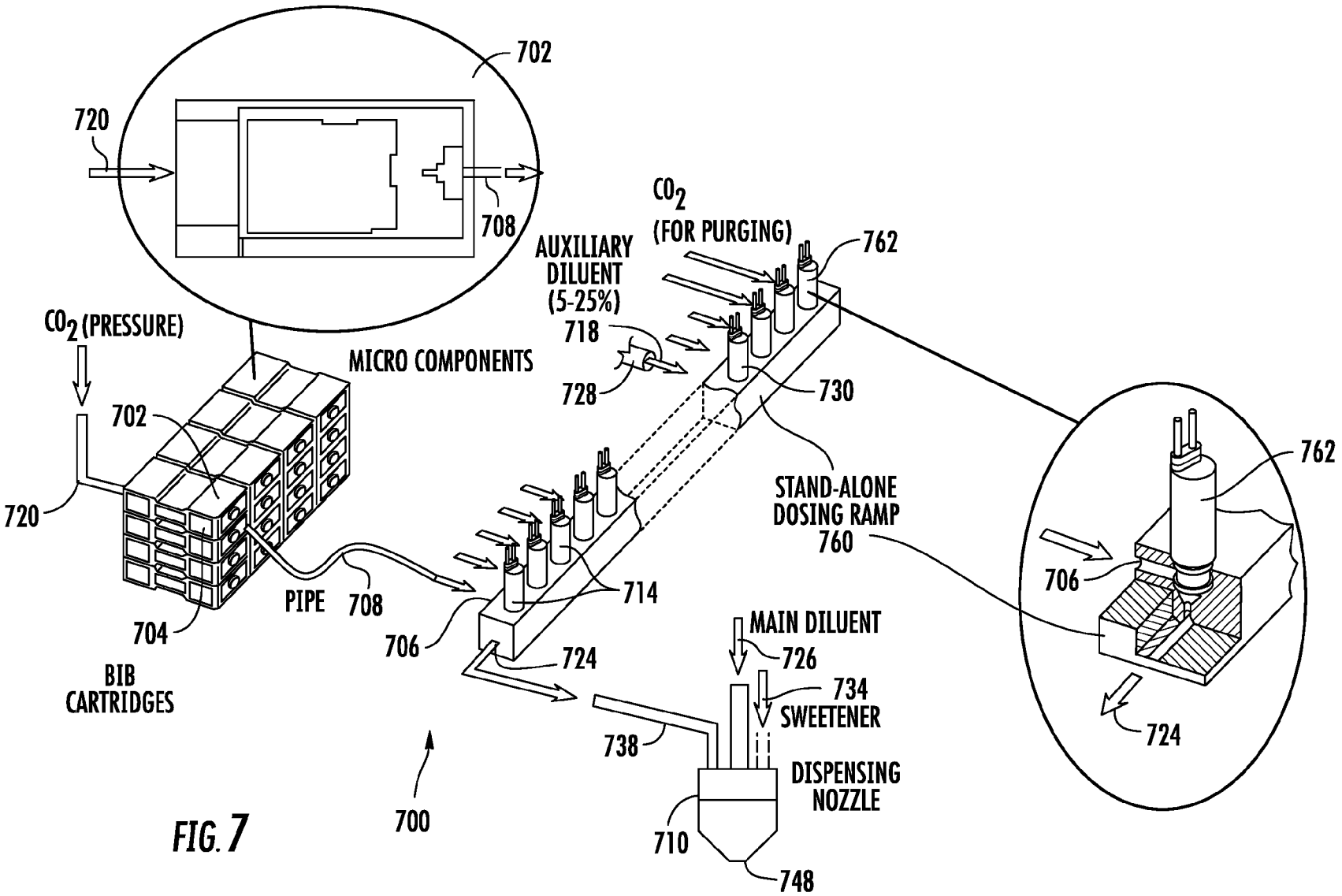
FIG. 7 illustrates a schematic view of an embodiment of a dispensing system in accordance with various aspects of the disclosure.

FIG. 7 illustrates aspects of a single delivery pipe configuration, including aspects illustrated in FIG. 6. FIG. 7 illustrates an assembly 700, comprising one or more cartridges 702. Each cartridge 702 may be a bag-in-box (BIB) cartridge. Each cartridge may comprise a component 704 for a free-flowing product, e.g., a micro component for free-flowing food product, such as a beverage. As shown in FIG. 7, gas pressure, e.g. carbon dioxide, may be used to push at least one micro component 704 from at least cartridge 702. Micro component 704 may correspond to a highly concentrated micro component 104 shown in FIG. 6, and cartridge 702 may correspond to a cartridge of source 102 shown in FIG. 6. Gas line 720, which supplies pressurized gas, may correspond to gas flow 602 shown in FIG. 6. Pipe 708 shown in FIG. 7 may correspond to pipe 608 shown in FIG. 6. Dispensing nozzle 748 may correspond to dispensing nozzle 138 shown in FIG. 6.

Cartridge 702 may be one of a plurality of sources. Those of skill in the art will recognize that in accordance with the present disclosure a transfer unit, plurality of sources and/or portions thereof that feed a dispenser with a free flowing product may be located remotely from a counter, such as in a back room, or at the counter, such as below or over the counter.

Pipe 708 may be used to transport highly concentrated micro component 704 to a dosing ramp 760. Dosing ramp 760 may be a stand-alone dosing ramp. As shown in FIG. 7, dosing ramp 760 may comprise a plurality of injectors and/or valves 714. Each injector and/or valve 714 may comprise a solenoid valve. Each injector and/or valve 714 may correspond to a micro component valve 118 as shown in FIG. 4, or a dosing injector, such as dosing injectors 604, 612, or 616 shown in FIG. 6. An injector may be pulsed many times per second, allowing droplets to pass. A solenoid may be configured to open or close for a longer period of time than pulsing of an injector, and regardless of defined orifice or length of tube to control flow. As shown in FIG. 7, a micro component 704 can enter an inlet 706 of a valve 714 that corresponds to that micro component. In one embodiment, each micro component has a corresponding valve 714. In one embodiment, a diluent 718 can flow through a pipe 728, which serves as an inlet pipe for an auxiliary stream of diluent 718 into dosing ramp 760. The auxiliary stream of diluent may be dosed by an injector and/or valve(S) 730. Pipe 738 may correspond to pipe 108 shown in FIG. 4 and FIG. 6. Injector and/or valve 714 may correspond to injector 604 shown in FIG. 6. Diluent 718 may correspond to diluent 132 shown in FIG. 4 and FIG. 6. Pipe 728 may correspond to pipe 308 shown in FIG. 4 and FIG. 6.

As shown in FIG. 7, valves 762 may be used to purge micro components and/or diluent in line 738. Line 738 may correspond to line 108 as shown in FIG. 4 and FIG. 6. Purging can be accomplished by sending pressurized gas, e.g. carbon dioxide, through purging valves 762. Main diluent flow 726 may correspond to main diluent flow 144 shown in FIG. 3 and FIG. 4. Sweetener 734 may correspond to sweetener 134 shown in FIG. 4 and FIG. 6. Dispensing nozzle 748 may correspond to dispensing nozzle 138 shown in FIG. 4 and FIG. 6. As shown in FIG. 7, line 738, which may include a mixture of a micro component(s) from pipe 708 and diluent, e.g., auxiliary diluent 718 from auxiliary diluent line 728, may be further combined or mixed with diluent from the main diluent line 726 at dispenser 710, where a finished product is formed and dispensed through dispensing nozzle 748.

Valve 762 and valve 730 may have the same or similar structure as valve 714. FIG. 7 illustrates aspects a valve 762 in dosing ramp 760. As shown in FIG. 7, valves 762, 730, and 714 comprise a plurality of valves in series, and these valves may be included in dosing ramp 760. Each of valves 762, 730 and 714 may have an inlet 706, and an outlet 724. Outlet 724 of the last valve 714 in the series of valves in dosing ramp 760 may then feed line 738. Thus, outlet 724 of the last valve 714 of dosing ramp 760 may include a dosed micro component or a mixture of dosed micro components, and may include a diluent, e.g., auxiliary diluent. When washing with a diluent, the outlet 724 of the last valve 714 of dosing ramp 760 may include just the washing diluent. When purging with a gas is conducted, the outlet 724 of the last valve 714 of dosing ramp 760 may include the purging gas.

Figure 8:
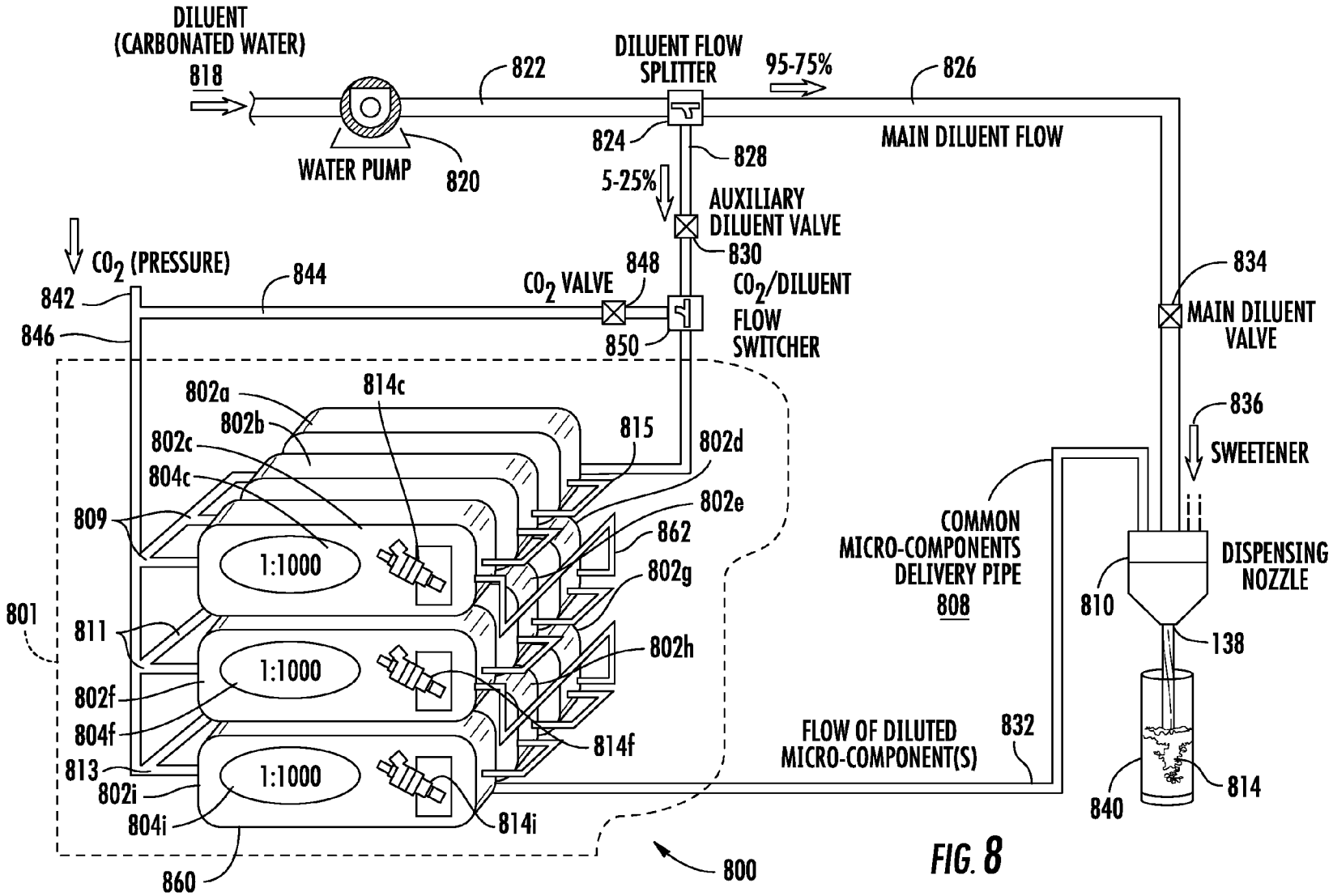
FIG. 8 illustrates a schematic view of an embodiment of a dispensing system in accordance with various aspects of the disclosure.

FIG. 8 is a schematic view of an embodiment of a dispensing system 800 according to various aspects of the disclosure. Dispensing system 800 may comprise apparatus 801. Apparatus 801 may comprises a plurality of cartridges 860 and a manifold apparatus 862. The apparatus 801 may be the centralized ingredient system. Plurality of cartridges 860 may include cartridges 802*a*, 802*b*, 802*c*, 802*d*, 802*e*, 802*f*, 802*g*, 802*h*, and 802*i*. Each cartridge may have a corresponding concentrated micro component, e.g., a beverage ingredient, 804*a*, 804*b*, 804*c*, 804*d*, 804*e*, 804*f*, 804*g*, 804*h*, and 804*i*, respectively. Each cartridge may have a corresponding built-in dosing device 814*a*, 814*b*, 814*c*, 814*d*, 814*e*, 814*f*, 814*g*, 814*h*, and 814*i*, respectively. The embodiment shown in FIG. 8 includes a single delivery pipe 808 between the plurality of cartridges 860 and dispenser 810. The embodiment shown in FIG. 8 is similar to the embodiment shown in FIG. 6, with the exception that a built-in dosing device is provided for each cartridge, as opposed to a dosing injector, such as injector 604, which is separated from a corresponding source 102 by a pipe, such as pipe 608, as shown in FIG. 6. Each micro component may be a highly concentrated micro component, like micro component 104 in FIG. 6. By way of example, but not limitation, the system is configured to dose a highly concentrated free-flowing micro component wherein the ratio by weight of the highly concentrated free-flowing micro component to a diluent (e.g., water) may be the following: high fructose corn syrup (HFCS)—at least 5:1; non-nutritive sweetener—at least about 30:1, e.g., between 25:1 and 45:1; tea—about 40:1; lemonade flavoring—at least 100:1; non-cola carbonated soft drink—at least 150:1; carbonated cola soft drink—at least 500:1. For a relatively pure concentrate, the ratio by weight of a highly concentrated free-flowing micro component to a diluent (e.g., water) is at least 200:1.

As shown in FIG. 8, an embodiment may comprise a single delivery pipe 808 for delivery of micro components to a dispenser 810, which may include a dispensing nozzle 838.

As shown in FIG. 8, carbon dioxide, nitrogen ($N_2$), or other gas may be used to apply pressure separately to and/or in each cartridge to push a highly concentrated micro component out of a corresponding cartridge and a corresponding dosing injector. The carbon dioxide, nitrogen ($N_2$), or other gas may be supplied from line 842. Line 842 may split into lines 844 and 846. As shown in FIG. 8, line 846 may be a line that supplies gas to the cartridges, and this gas may apply pressure separately to and/or in each cartridge to push the respective highly concentrated micro components therefrom. Manifold 809 may be used to supply gas from line 846 to cartridges 802*a*, 802*b*, 802*c*. Manifold 811 may be used to supply gas from line 846 to cartridges 802*d*, 802*e*, and 802*f*. Manifold 813 may be used to supply gas from line 846 to cartridges 802*g*, 802*h*, and 802*i*. Those skilled in the art will recognize that in accordance with the disclosure other manifold designs may be sued to supply gas to cartridges.

As shown in FIG. 8, gas supplied from line 846 may be used to push a micro component out of a corresponding cartridge and a built-in dosing device. Each built-in dosing device may be configured to dose an appropriate amount of micro component so that it may mix with diluent from auxiliary pipe 828 to form a diluted micro component, which may then flow through effluent manifold 862. The cartridges may be in series, as shown in FIG. 8. Those of skill in the art will recognize that in accordance with the disclosure cartridges may be in a parallel configuration, or some cartridges may be in a series configuration and other cartridges may be in a parallel configuration.

Gas may be sent to cartridge or bottle 802*a*. If the micro component of cartridge 802*a* is to be used to make a free flowing product to be dispensed from dispenser 810, then the micro component of cartridge 802*a* is allowed to be dosed by the corresponding built-in dosing device of cartridge 802*a*, and the effluent from cartridge 802*a* comprises the dosed micro component of cartridge 802*a* and auxiliary diluent from auxiliary pipe 828. Effluent from cartridge 802*a* is fed through pipe 815 of effluent manifold 862 to cartridge 802*b*. If the micro component of cartridge 802*a* is not needed to make a free flowing food product (e.g., a beverage) to be dispensed from dispenser 810, then no micro component of cartridge 802*a* is allowed to be dosed by the corresponding built-in dosing device of cartridge 802*a*, and the only effluent from cartridge 802*a* is the auxiliary diluent from auxiliary pipe 828. The process may continue until each micro component to be used to make the free flowing product has been dosed. Effluent 832, which may be a micro component, or a combination of auxiliary diluent and micro component(s), is then sent from apparatus 801 through common delivery pipe 808 to dispenser 810.

Diluent 818 may be pumped by diluent pump 820 through pipe 822. After being pumped by diluent pump 820 through pipe 822, diluent 818 may enter a diluent flow splitter 824. At diluent flow splitter 824, diluent 818 may be split into a main diluent flow pipe 826, and an auxiliary diluent flow pipe 828. In one embodiment, about 75-95% of the diluent 818 from pipe 822 goes to main diluent flow pipe 826, and about 5-25% of the diluent 818 goes to the auxiliary diluent flow pipe 828. Diluent 818 flowing through auxiliary diluent flow pipe 828 may flow through auxiliary diluent valve 830, and then flow to gas/diluent flow switcher 850. The effluent from gas/diluent flow switcher 850 may flow to built-in dosing device (not shown) of cartridge 802*a*, where it may be mixed with highly concentrated micro component of cartridge 802*a*.

As shown in FIG. 8, line 842 may supply gas to valve 848, and the gas may then be supplied to gas/diluent flow switcher 850. Thus, gas may be supplied to gas/diluent flow switcher or flow combiner 850 when desired, for example, when it is desired to purge any liquid(s) in pipes or lines or dispensing nozzles downstream of gas/diluent flow switcher 850, or to add gas to the diluent (e.g., to increase carbonation in a the free flowing product to be dispensed from the dispenser 810.

Built-in dosing devices, e.g., built-in dosing devices 814*c*, 814*f*, and 814*i*, of the cartridges shown in FIG. 8 may correspond to injector 604 and flow mixer 606 shown in FIG. 6. Thus, built-in dosing devices may comprise an injector and flow mixer.

Those skilled in the art will recognize that in accordance with the disclosure built-in dosing devices may comprise injectors and/or valves, for example, injector and/or valve 714 shown in FIG. 7.

Those skilled in the art will recognize that in accordance with the disclosure while the cartridges shown in FIG. 8 are in a serial configuration, other configurations are contemplated in accordance with this disclosure. For example, a first set of cartridges and a second set of cartridges may have a parallel configuration with respect to each other, with each set of cartridges having cartridges in a serial configuration. Those skilled in the art will recognize that in accordance with the disclosure combinations of configurations shown in FIGS. 6, 7 and 8 are contemplated in accordance with this disclosure. For example, cartridges 802*a*, 802*d*, and 802*g* may be in a parallel flow configuration with respect to each other; diluent through auxiliary diluent flow pipe 828 may be fed directly to cartridges 802*a*, 802*d*, and 802*g*, and the effluent of cartridges 802*a*, 802*d* and 802*g*, which may be in a parallel configuration with respect to each other, may be combined to provide flow of a diluted micro component stream through delivery pipe 808 and fed to dispenser 810.

As shown in FIG. 8, diluent 818 flowing through main diluent flow pipe 826 may flow through main diluent valve 834, and then may flow to dispenser 810. Sweetener 836 may also be delivered to dispenser 810. Dispenser 810 may have a dispensing nozzle 838. At dispenser 810, all of the components for the free flowing product may be combined into a finished product 814 (e.g., a food product, such as a beverage), and the finished product 814 may then dispensed through the dispenser 810 into a cup or container 840.

Figure 9:
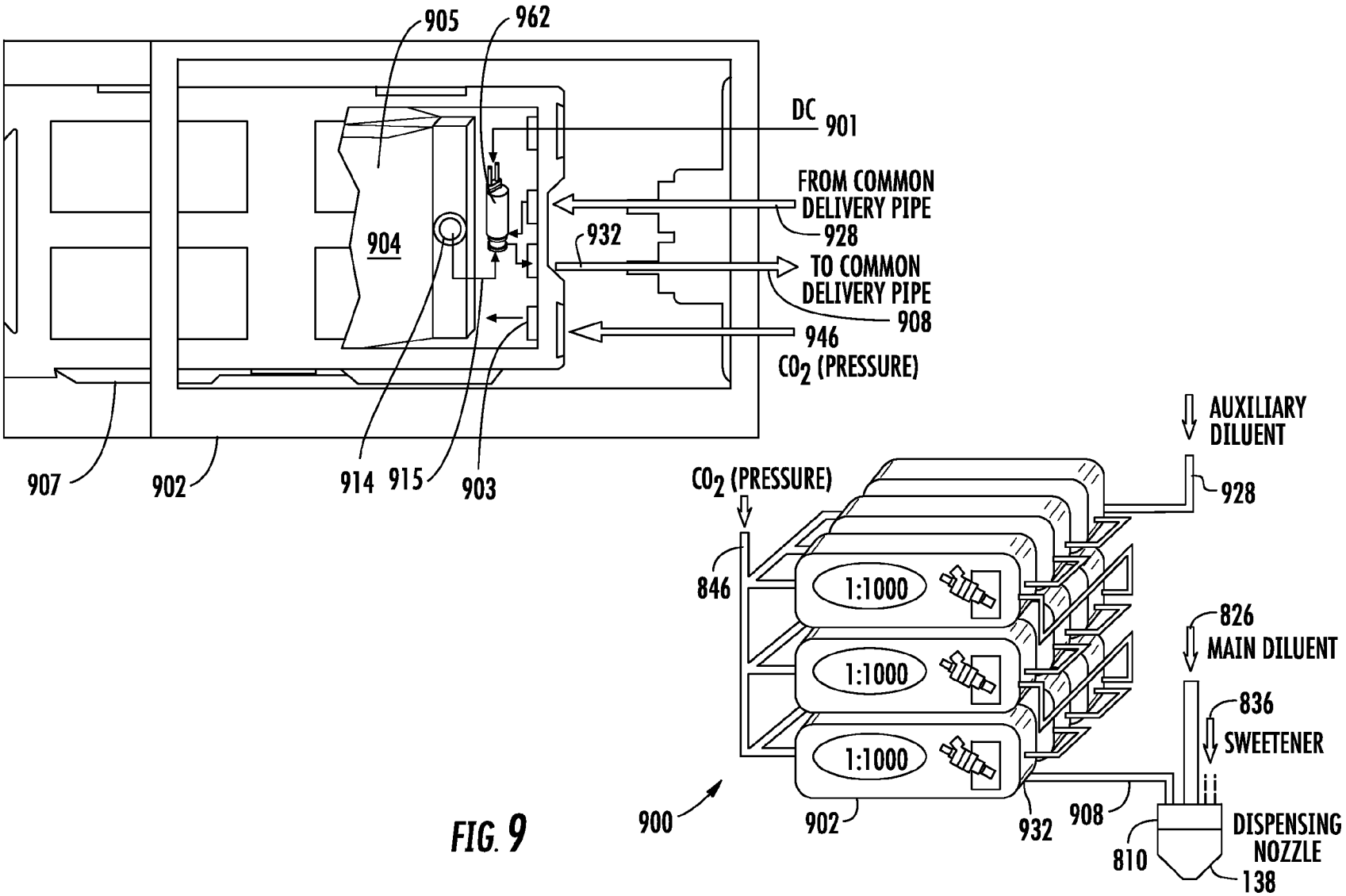
FIG. 9 illustrates an apparatus having a built in dosing device in accordance with various aspects of the disclosure.

FIG. 9 illustrates an apparatus having a built in dosing device in accordance with various aspects of the disclosure. Apparatus 900 may have a cartridge 902. Cartridge 902 may comprise a built-in dosing device 962. Built-in dosing device 962 may be any of the built-in dosing devices depicted in FIG. 7 and FIG. 8. Built-in dosing device 962 may be a valve, e.g., a solenoid valve. Direct current (DC) line 901 may provide direct current to open and close built-in dosing device 962. Pressure from a gas, for example carbon dioxide, may flow through line 946 and opening 903, and place pressure on bag 905 contained within box 907 of cartridge 902. Line 946 may correspond to line 846 previously discussed in connection with FIG. 8.

Pressure from the gas may compress bag 905, thereby forcing highly concentrated micro component 904 from bag 905 through valve 914 and line 915 to built-in dosing device 962. Built-in dosing device 962 may be configured to open or close due to direct current from direct current line 901.

Diluent from diluent line 928 may be mixed with highly concentrated micro component 904 in built-in dosing device 962 to form diluted micro component 932. Diluted micro component 932 may be sent from cartridge 902 through delivery pipe 908 to a dispenser 810. Delivery pipe 908 may correspond to delivery pipe 808 previously discussed in connection with FIG. 8.

Cartridge 902 may correspond to any of the cartridges described above, including but not limited to the cartridges of FIG. 9. Built-in dosing device 962 may include dosing devices, injectors or valves described above with respect to FIG. 2, FIG. 3, FIG. 4, FIG. 6, FIG. 7, and FIG. 8.

Those of skill in the art will recognize that, in accordance with the disclosure, cartridge 902 may have any suitable built-in micro dosing device appropriate for the micro component to be supplied from cartridge 902. Cartridges having different micro components may have different micro dosing devices. For example, injectors or electro-hydrodynamic (EHD) pumps may be deemed useful for micro dosing of a micro component, such as a flavor, having a ratio by weight of micro component to diluent in the range of about 150:1 to 200:1. A positive displacement (PD) pumps may be deemed useful for micro dosing of a micro component, such as a juice concentrate, or a sweetener, etc., having a ratio by weight of micro component to diluent in the range of about 100:1 to 150:1.

Figure 10:
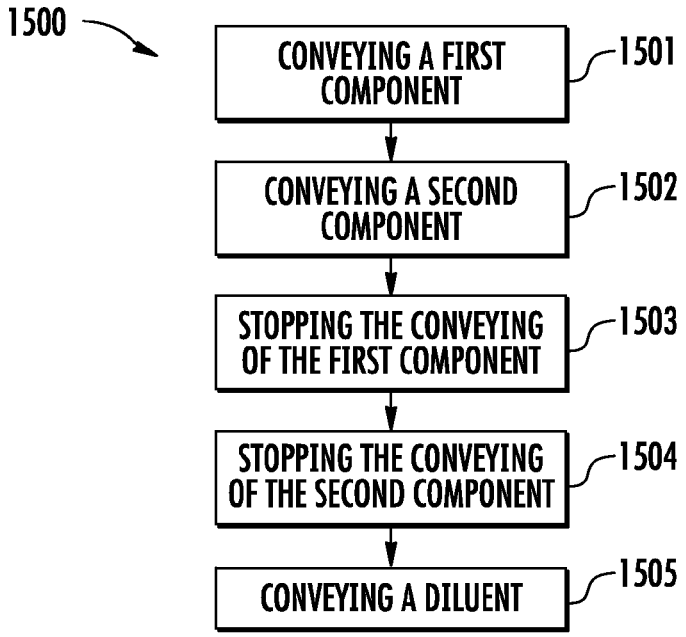
FIG. 10 illustrates a flow diagram of a method in accordance with various aspects of the disclosure.

FIG. 10 illustrates a flow diagram of a method 1500 in accordance with various aspects of the disclosure. In step 1501, conveying a first component of a free flowing food product through a common delivery pipe to a dispenser for a first period of time occurs. In step 1502, conveying a second component of a free flowing food product through the common delivery pipe to a dispenser for a second period of time occurs. In step 1503, stopping the conveying of the first component for the first period of time occurs. In step 1504, stopping the conveying of the second component occurs. In step 1505, upon stopping the conveying of the first component and the second component, conveying a diluent for a third period of time through the common delivery pipe to wash any of the remaining first component and any of the second component away from the common delivery pipe occurs.

In an aspect of the disclosure, after the third period of time ends and the conveying of the diluent stops, the method may further comprise conveying a gas for a fourth period of time to purge any of remaining diluent away from the common delivery pipe.

Those of skill in the art will recognize that, in accordance with the disclosure, a controller, such as controller 1202 previously discussed, may be configured to control the operation of any of the apparatus and devices described above.

Figure 11:
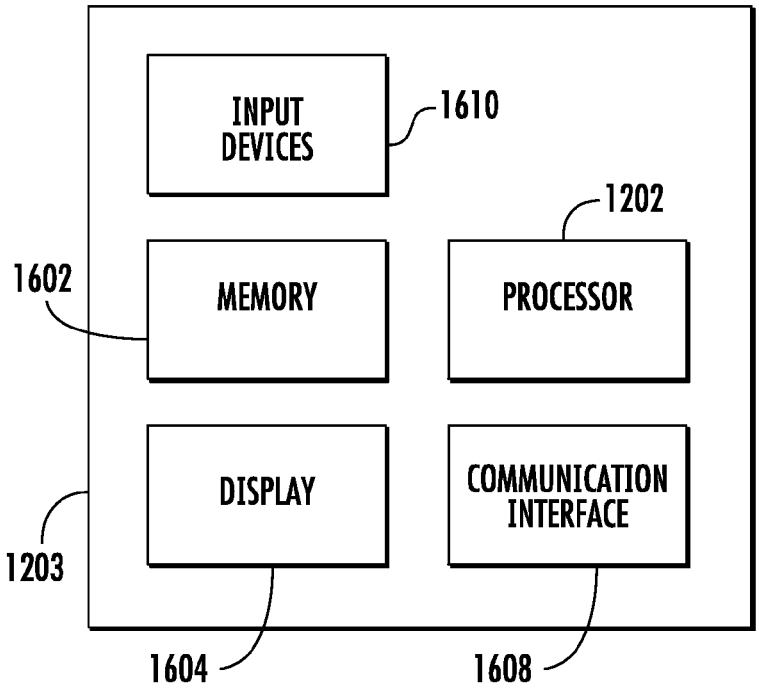
FIG. 11 illustrates a dosing control unit in accordance with various aspects of the disclosure.

FIG. 11 illustrates an example of a dosing control unit 1203, as shown in FIG. 1. Dosing control unit 1203 may comprise a controller 1202 as shown in FIG. 1, FIG. 2, FIG. 3, and FIG. 6. Controller 1202 may comprise a processor. Dosing control unit 1203 may further comprise at least one non-transitory memory 1602, a display 1604, and a communication interface 1608. Controller 1202 may execute computer-executable instructions present in non-transitory memory 1602 such that, for example, dosing control unit 1203 may send and receive information via a network (not shown).

Dosing control unit 1203 may further include or be in communication with a system bus (not shown). A system bus may be any of several types of bus structures including a memory bus or memory controller, a peripheral bus, and a local bus using any of a variety of bus architectures. The structure of system non-transitory memory is well known to those skilled in the art and may include a basic input/output system (BIOS) stored in a read only memory (ROM) and one or more program modules such as operating systems, application programs and program data stored in random access memory (RAM). Dosing control unit 1203 may be configured to allow dosing control unit 1203 to communicate other devices in system 1200, for example, micro-component pump 1208, micro dosing device 1204, micro-component valve 1210, water pump 1212, and/or main diluent valve 1214. Dosing control unit 1203 may also include a variety of interface units and drives (not shown) for reading and writing data.

Those of skill in the art will recognize that, in accordance with the disclosure, any suitable network connections and other ways of establishing a communications link between dosing control unit 1203 and other devices in system 100 of FIG. 1, system 300 of FIG. 2, system 400 of FIG. 3, and system 600 of FIG. 6. The existence of any of various well-known protocols, such as TCP/IP, Frame Relay, Ethernet, FTP, HTTP and the like, is presumed, and a central processor unit or computer may be operated in a client-server configuration to permit a user to retrieve web pages from a web-based server. Furthermore, any of various conventional web browsers may be used to display and manipulate data on web pages.

Those of skill in the art will recognize that, in accordance with the disclosure, dosing control unit 1203 may include an associated computer-readable medium containing instructions for controlling any of previously described systems 100, 300, 400, and 600, and implement the exemplary embodiments that are disclosed herein.

Dosing control unit 1203 may also include various input devices 1610. Input devices 1610 may include keyboards, track balls, readers, mice, joy sticks, buttons, and bill and coin validators.

Those of skill in the art will recognize that in accordance with the disclosure any of the features and/or options in one embodiment or example can be combined with any of the features and/or options of another embodiment or example.

The disclosure herein has been described and illustrated with reference to the embodiments of the figures, but it should be understood that the features of the disclosure are susceptible to modification, alteration, changes or substitution without departing significantly from the spirit of the disclosure. For example, the dimensions, number, size and shape of the various components may be altered to fit specific applications. Accordingly, the specific embodiments illustrated and described herein are for illustrative purposes only and the disclosure is not limited except by the following claims and their equivalents.

We claim:

1. An apparatus comprising:

a first source of a first component, the first component being one component for a finished free flowing food product and comprising a highly concentrated micro component;

a second source of a second component, the second component being another component for the finished free flowing food product;

a flow combiner;

the flow combiner configured to receive the first component from the first source;

the flow combiner configured to receive the second component from the second source;

the flow combiner configured to combine the first component with the second component to form a first mixture;

a common delivery pipe, the common delivery pipe configured to receive the first mixture from the flow combiner;

a third source of a diluent flow;

a flow splitter configured to split the diluent flow into a main diluent flow and an auxiliary diluent flow, wherein flow from the auxiliary diluent flow provides a washing flow that washes away a portion of the first component and a portion of the second component from the common delivery pipe; and a dispenser, the dispenser comprising a dispensing nozzle, the dispenser configured to receive diluent flow from the third source, receive the first mixture from the common delivery pipe, combine the diluent flow with the first mixture to form a second mixture, and dispense the second mixture through the dispensing nozzle, the second mixture comprising the finished free flowing food product.

2. The apparatus of claim 1 wherein the first source is a first cartridge and the second source is a second cartridge.

3. The apparatus of claim 1 wherein the second component is selected from the group consisting of a second highly concentrated micro component and a macro component.

4. The apparatus of claim 1 wherein the finished free-flowing food product comprises a beverage.

5. The apparatus of claim 1 further comprising a sweetener source, wherein the dispenser is configured to receive sweetener from the sweetener source and combine the sweetener, the first mixture, and the main diluent flow to form the finished free-flowing food product.

6. The apparatus of claim 1 further comprising a first micro dosing device configured to dose the first component to the flow combiner.

7. The apparatus of claim 6 further comprising a second micro dosing device configured to dose the second component to the flow combiner.

8. The apparatus of claim 1 wherein the first source comprises a highly concentrated micro component having a ratio by weight to a diluent of at least about 30:1.

9. The apparatus of claim 1 wherein the first source comprises a highly concentrated micro component having a ratio by weight to a diluent of at least about 1000:1.

10. The apparatus of claim 1 further comprising an auxiliary diluent flow source configured to convey an auxiliary diluent flow to the flow combiner.

11. An apparatus comprising:

a first source of a first component, the first component being one component for a finished free flowing food product and comprising a highly concentrated micro component;

a second source of a second component, the second component being another component for the finished free flowing food product;

a third source of a main diluent flow;

a fourth source of an auxiliary diluent flow;

a fifth source of a diluent flow and a flow splitter configured to split the diluent flow from the fifth source into the third source and the fourth source;

a first flow combiner;

the first flow combiner configured to receive the first component from the first source;

the first flow combiner configured to receive auxiliary diluent flow from the fourth source;

the first flow combiner configured to combine the first component with the auxiliary diluent flow to form a first intermediate mixture;

a second flow combiner;

the second flow combiner configured to receive the first intermediate mixture from the first flow combiner;

the second flow combiner configured to receive the second component from the second source;

the second flow combiner configured to combine the first intermediate mixture with the second component to form a second intermediate mixture;

a common delivery pipe;

the common delivery pipe configured to receive the second intermediate mixture from the second flow combiner; and a dispenser, the dispenser comprising a dispensing nozzle;

the dispenser configured to receive main diluent flow from the third source;

the dispenser configured to receive the second intermediate mixture from the common delivery pipe;

the dispenser configured to combine the main diluent flow with the second intermediate mixture to form a finished free flowing food product, and dispense the finished free flowing food product, wherein flow from the fourth source provides a washing flow that washes away a portion of the first component and a portion of the second component from the common delivery pipe.

12. The apparatus of claim 11 wherein the first source is a first cartridge and the second source is a second cartridge.

13. The apparatus of claim 11 wherein the second component is selected from the group consisting of a second highly concentrated micro component and a macro component.

14. The apparatus of claim 11 further comprising a fifth source of a diluent flow the flow splitter configured to split the diluent flow from the fifth source into the third source and the fourth source.

15. The apparatus of claim 11 further comprising:

a first component dosing device;

a first component valve, the first component valve configured to be in an open position when desired to convey the first component from the first component dosing device to the first flow combiner, the first component valve configured to be in a closed position when desired to not convey the first component from the first component dosing device to the first flow combiner;

a second component dosing device;

a second component valve, the second component valve configured to be in an open position when desired to convey the second component from the second component dosing device to the second flow combiner, the second component valve configured to be in a closed position when desired to not convey the second component from the second component dosing device to the second flow combiner; and an auxiliary diluent valve, the auxiliary diluent valve configured to be in an open position when desired to convey the auxiliary diluent flow from the fourth source to the first flow combiner, the auxiliary diluent valve configured to be in a closed position when desired to not convey the auxiliary diluent flow from the fourth source to the first flow combiner.

16. The apparatus of claim 11 further comprising:

a gas source configured to convey a gas to the first flow combiner when desired to purge any of the first component, the second component, the auxiliary diluent flow, and mixtures thereof from the common delivery pipe.

17. The apparatus of claim 16 wherein the gas source comprises a gas valve;

the gas valve configured to be in an open position when desired to convey the gas from the gas source to the first flow combiner;

the gas valve configured to be in a closed position when not desired to convey the gas from the gas source to the first flow combiner.

18. The apparatus of claim 17 further comprising a third flow combiner configured to receive the gas from the gas valve and convey the gas to the first flow combiner when the gas valve is in the open position.

19. A method comprising:

conveying a first component of a free flowing food product through a common delivery pipe to a dispenser for a first period of time;

conveying a second component of a free flowing food product through the common delivery pipe to a dispenser for a second period of time;

stopping the conveying of the first component;

stopping the conveying of the second component;

upon stopping the conveying of the first component and the second component, conveying an auxiliary diluent flow through a flow splitter for a third period of time through the common delivery pipe to wash any of the remaining first component and any of the second component away from the common delivery pipe, the flow splitter configured to split a flow of diluent into a main diluent flow and the auxiliary diluent flow.

20. The method of claim 19 further comprising conveying a gas for a fourth period of time to purge any of the remaining auxiliary diluent away from the common delivery pipe after the third period of time ends and the conveying of the diluent stops.

* * * * *